US005366014A

United States Patent [19]

George

[11] Patent Number: 5,366,014

[45] Date of Patent: Nov. 22, 1994

[54] METHOD AND APPARATUS FOR PERFORATING A WELL USING A MODULAR PERFORATING GUN SYSTEM

[75] Inventor: Flint R. George, Flower Mound, Tex.

[73] Assignee: Halliburton Company, Houston, Tex.

[21] Appl. No.: 148,145

[22] Filed: Nov. 4, 1993

[51] Int. Cl.[5] ..... E21B 43/00

[52] U.S. Cl. ..... 166/297; 166/55

[58] Field of Search ..... 166/297–299, 166/55–55.2

[56] References Cited

U.S. PATENT DOCUMENTS

| | | | |
|---|---|---|---|
| 2,749,840 | 6/1956 | Babcock | 102/20 |
| 2,799,224 | 7/1957 | Long | 102/20 |
| 2,853,944 | 9/1958 | Robertson | 102/20 |
| 2,873,675 | 2/1959 | Lebourg | 102/20 |
| 2,876,843 | 3/1959 | Huber | 166/55 |
| 2,906,339 | 9/1959 | Griffin | 166/35 |
| 2,981,185 | 4/1961 | Caldwell | 102/20 |
| 3,032,109 | 5/1962 | Corley, Jr. et al. | 166/55.4 |
| 3,706,344 | 12/1972 | Vann | 166/297 |
| 3,966,236 | 6/1976 | Vann | 285/39 |
| 4,066,282 | 1/1978 | Vann | 285/39 |
| 4,078,611 | 3/1978 | Vann | 166/297 |
| 4,113,016 | 9/1978 | Trott | 166/297 |
| 4,122,899 | 10/1978 | Brieger | 166/297 |
| 4,199,210 | 4/1980 | Trott | 339/96 |
| 4,355,685 | 10/1982 | Beck | 166/240 |
| 4,375,834 | 3/1983 | Trott | 166/297 |
| 4,526,233 | 7/1985 | Stout | 166/377 |
| 4,557,331 | 12/1985 | Stout | 166/297 |
| 4,612,992 | 9/1986 | Vann et al. | 166/297 |
| 4,614,156 | 9/1986 | Colle, Jr. et al. | 102/312 |
| 4,619,333 | 10/1986 | George | 166/297 X |
| 4,694,878 | 9/1987 | Gambertoglio | 166/377 |
| 4,771,827 | 9/1988 | Barker et al. | 166/55.1 |
| 4,776,393 | 10/1988 | Forehand et al. | 166/55.1 |
| 4,805,696 | 2/1989 | Henderson | 166/114 |
| 4,815,540 | 3/1989 | Wallbillich, III | 166/377 |
| 4,905,759 | 3/1990 | Wesson et al. | 166/55 |
| 5,025,861 | 6/1991 | Huber et al. | 166/297 |
| 5,156,213 | 10/1992 | George et al. | 166/297 |

OTHER PUBLICATIONS

Vann Systems Engineered Well Completions Catalog TCP-1007, "Pressure Actuated Tubing Release (PATR)"—undated but admitted to be prior art.

*Primary Examiner*—Michael Powell Buiz

*Attorney, Agent, or Firm*—Tracy W. Druce; Lucian Wayne Beavers

[57] ABSTRACT

A modular perforating gun system for use in perforating a well. The system comprises a lower perforating gun module or section which may be supported in a variety of ways adjacent to a well formation to be perforated. The system further comprises at least one additional perforating gun module or section which is positioned above the lower perforating gun module. After firing, any number of the perforating gun modules may be individually retrieved from the wellbore without killing the well and subsequently replaced as necessary.

18 Claims, 3 Drawing Sheets

METHOD AND APPARATUS FOR PERFORATING A WELL USING A MODULAR PERFORATING GUN SYSTEM

BACKGROUND OF THE INVENTION

1. Field Of The Invention

This invention relates to apparatus and methods for perforating wells, and more particularly, to a modular gun system and method of use utilizing a plurality of perforating guns which may be individually positioned in a wellbore and individually removed therefrom.

2. Description Of The Prior Art

In the past, tubing conveyed perforating systems for use in completing wells have been conveyed into the wells on a tubing or pipe string with the string left in position in the well during the perforating of the well. After perforating of the well, the perforating guns may have disintegrated or may be retrieved, or may be released or dropped from the tubing or pipe string through the use of various techniques.

More recently, an automatically releasing gun hanger has been proposed as shown in U.S. Pat. No. 5,156,213 to George et al., assigned to the assignee of the present invention. The George et al. '213 patent describes an automatically releasing gun hanger which is run into the well on a rigid tubing string or pipe string. The gun hanger is set within the well by a rotating motion of the rigid tubing string or pipe string. The rigid tubing string or pipe string is then disconnected from the guns attached to the gun hanger through further rotational motion. The pipe string can then be removed from the well. The perforating gun is fired by a pressure actuated firing head and upon firing of the perforating gun, the gun hanger automatically releases, thus allowing the guns to drop to the bottom of the well and leave an unobstructed flow path from the perforations up through the wellbore.

Even more recently, it has been proposed to run the perforating guns into the well on a coiled tubing string. In such cases, rotation of the string is not possible, as with a rigid tubing string or pipe string. U.S. patent application Ser. No. 08/134,022 discloses a modified version of the apparatus shown in the George et al. '213 patent. In this modified version, the actuating mechanism of the gun hanger is modified so that it is operated by a simple reciprocating motion of the coiled tubing string without the need for any rotating motion. Also, a pressure responsive release mechanism connects the coiled tubing string to the perforating gun so that after the gun hanger has been set within the casing, pressure within the coiled tubing string may be increased to release the coiled tubing string from the perforating gun, thus allowing the coiled tubing string to be retrieved prior to firing of the perforating guns.

While both of the previously described apparatus work well, in some well situations problems may occur. For example, when there is an insufficient rathole below the well formation to drop the entire gun assembly a portion of the gun assembly may interfere with flow of fluids from the perforated formation. The present invention solves this problem by providing a modular gun system in which only the sections that remain across the perforations after firing need to be retrieved. In many completions, coiled tubing can be run and retrieved under pressure as a means to fish the gun modules. The modules can be short enough to be lubricated out at the surface which allows removal without killing the well.

Of course, a rigid tubing string or pipe string could also be used instead of coiled tubing.

There also may be a need to add additional perforations to an already live well. Many times after a well has produced for some time, the flow weakens to the point that additional perforating is needed without killing the well. With the modular gun system of the present invention, the guns can be lubricated into the well under pressure so that after all of the modules in place, the entire gun assembly can be fired at once.

There may be further occasions when all of the guns do not fire. When this occurs, the fired guns can be retrieved, thus recovering the failed section and allowing easy replacement of it with a new module.

SUMMARY OF THE INVENTION

The present invention provides a modular perforating gun system in which a plurality of gun modules or sections may be individually positioned in a wellbore and individually retrieved as necessary. This can be accomplished by positioning the tool with a running/disconnect tool which is used to run the modules into the well and unlatch therefrom. This tool can be run on a rigid tool string or pipe string, coiled tubing, or wireline.

The modular perforating gun system of the present invention may be described as a well perforating apparatus comprising a support means engagable with a portion of a wellbore for providing a gun support within the wellbore, and a plurality of perforating gun modules, one of the gun modules being supported by the support means. The remainder of the gun modules are supported by an adjacent gun module. In the preferred embodiment, the modules are stacked on top of one another, with the gun module supported by the support means being the lowermost gun module.

In one embodiment, the support means is characterized by a gun hanger which may be a portion of the lowermost gun module. Preferably, the gun hanger is an automatically releasing gun hanger.

In a second embodiment, the support means is characterized by a plug or other well blocking device positionable in the wellbore. In one embodiment, this plug is a retrievable bridge plug.

In a third embodiment, the support means is characterized by a length of pipe attached to the lowermost gun module and adapted for engaging a lower end of the wellbore.

While these three embodiments have been illustrated, it should be understood that the invention is not intended to be limited to only those shown, but can include any other support means which would be suitable for holding the gun modules in place prior to actuation of the guns and perforating the wellbore.

The invention may also be said to include a method of perforating a casing of a well, wherein the method comprises the steps of lowering a first perforating gun section into the casing, supporting the first perforating gun section in the casing adjacent to a first portion of a subsurface formation to be perforated, lowering an additional perforating gun section into the casing, supporting the additional perforating gun section on the first perforating gun section adjacent to another portion of the subsurface formation, and firing the perforating gun sections and thereby perforating the casing. The step of lowering an additional perforating gun section into the casing may be repeated as many times as necessary or desired. That is, the additional perforating gun section may be one of a plurality of additional perforating gun sections, each of the additional gun sections being supported on an adjacent perforating gun section.

The method may further comprise a step of retrieving at least one of the perforating gun sections from the casing and may further comprise a step of replacing at least one of the perforating gun sections and repositioning it in the wellbore for firing.

The step of supporting the first perforating gun section may comprise the steps of providing a gun hanger on the first perforating gun section, and setting said gun hanger into engagement with the well casing. The method may further comprise releasing the gun hanger from engagement with the casing after firing the perforating gun sections.

In another embodiment, the step of supporting the first perforating gun section may comprise the steps of, prior to lowering the first perforating gun section, setting a support member into engagement with the casing at a predetermined location, and engaging the first perforating gun section with a support member after lowering the first perforating gun section into the casing. The support member may be a bridge plug or any other suitable device capable of supporting the gun sections.

In still another embodiment, the step of supporting the first perforating gun section may comprise the steps of providing a length of pipe connected to a lower end of the first perforated gun section, and engaging the pipe with a lower surface in the wellbore.

Numerous objects and advantages of the invention will become apparent as the following detailed description of the preferred embodiment is read in conjunction with the drawings which illustrate such embodiments.

DETAILED DESCRIPTION OF THE PREFERRED EMBODIMENTS

Figure 1:
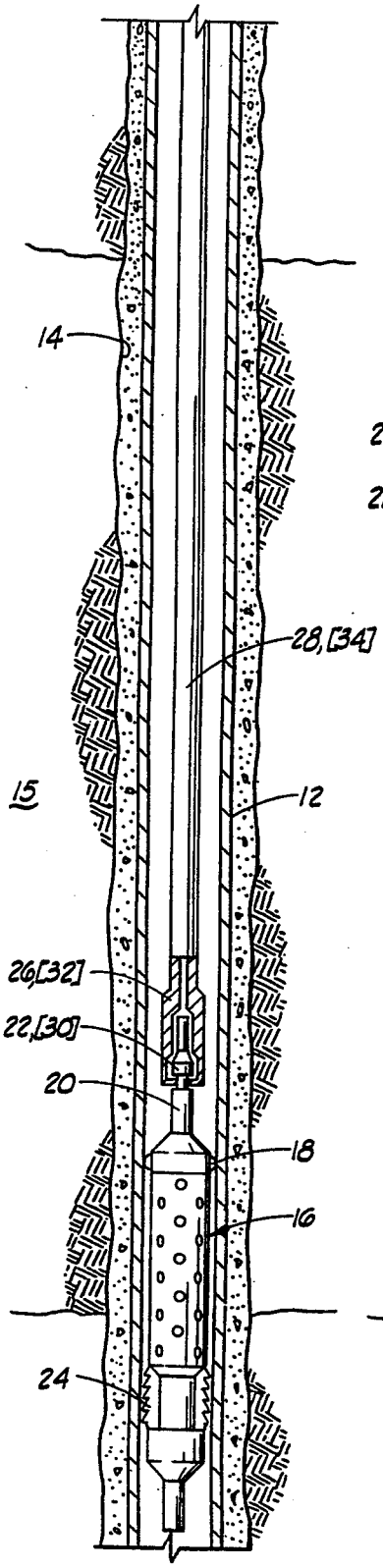
FIG. 1 is a schematic sectioned view of a well in which a first perforating gun module or section of a first embodiment of the modular gun system of the present invention is shown positioned in a well casing.
Figure 2:
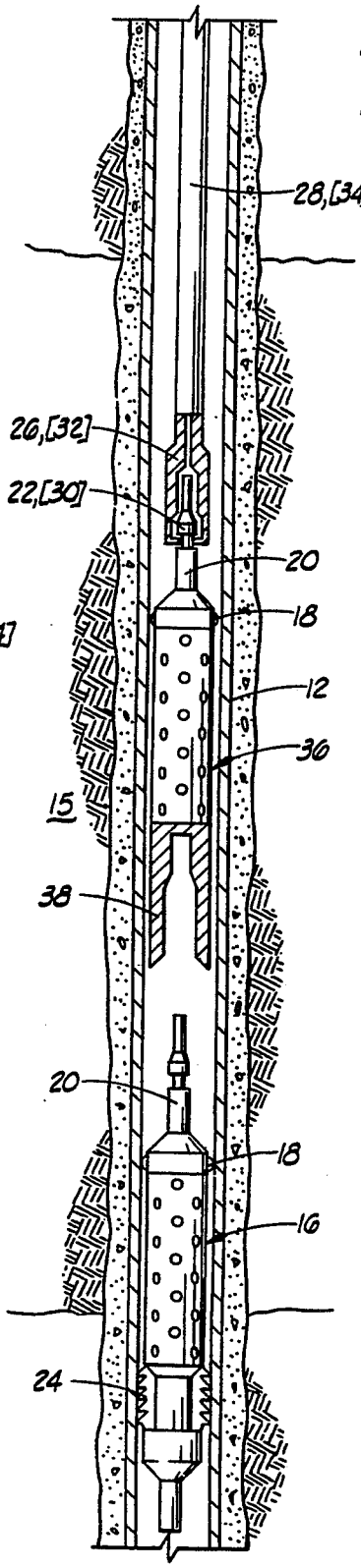
FIG. 2 shows the first embodiment with a second perforating gun module section being lowered over the first perforating gun section.
Figure 3:
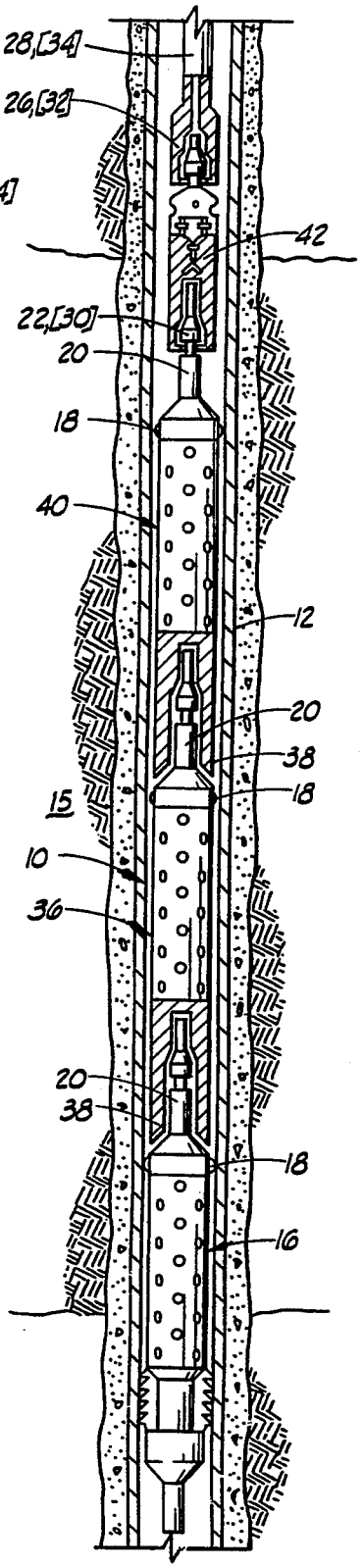
FIG. 3 shows the first embodiment modular gun system with a firing head positioned thereon.

Referring now to the drawings, and more particularly to FIGS. 1–3, a first embodiment of the perforating gun system of the present invention is shown and generally designated by the numeral 10. System 10 is positioned in a well casing 12 located in a wellbore 14. System 10 is adjacent to a well formation 15 to be perforated. Casing 12 is typically cemented in the wellbore 14.

System 10 includes a plurality of perforating gun assemblies, also called modules or sections, the lowermost of which is perforating gun section 16 (see FIG. 1). Lower perforating gun section 16 is a tubing conveyed perforating gun section. Lower perforating gun section 16 comprises a centralizer 18 to centralize the lower perforating gun section in liner 12, a firing head 20, an on-off mandrel 22 on the upper end of firing head 20, and a releasable gun hanger 24. On-off mandrel 22 may be of any suitable type which is capable of mating with a suitable on-off shoe 26 attached to the end of either a drill pipe workstring or tubing string 28 which is used to run lower perforating gun section 16 to the desired location in casing 12.

Alternatively, lower perforating gun section 16 may have a firing head extension 30 at the upper end of firing head 20 which is engaged by a pressure responsive release mechanism 32 connected to the lower end of coiled tubing string 34. A further alternative would be to run lower perforating gun assembly 16 into casing 12 on a wireline.

Regardless of whether lower perforating gun section 16 is positioned by a wireline, a rigid work or pipe string, or a more flexible workstring such as a coiled tubing string, gun hanger 24 is set into locking engagement with casing 12 in a manner known in the art. At this point, gun hanger 24 will support lower perforating gun section 16, and workstring 28 or tubing string 34 is disconnected from lower perforating gun section 16 and removed from the well.

Referring now to FIG. 2, a second perforating gun module or section 36 is shown being lowered into casing 12. Second perforating gun section 36 is similar to lower perforating gun section 16, except that second perforating gun section 36 does not have a gun hanger attached to the lower end thereof. Rather, second perforating gun section 36 has a lower end 38 which is substantially cylindrical in configuration and is adapted to fit over firing head 20 on lower perforating gun section 36, as best seen in FIG. 3. Thus, second perforating gun section 36 simply stacks on lower perforating gun section 16, and both of the gun sections are supported by gun hanger 24. When in the stacked position shown in FIG. 3, second gun section 36 is operatively connected to lower perforating gun section 16 so that when the upper perforating gun section is fired, the lower perforating gun section is fired sequentially. While the stacking arrangement of the present invention is new, the operative connection between gun sections is of a kind known in the art.

Still referring to FIG. 3, a third perforating gun section 40 is shown stacked on second perforating gun section 36. Third perforating gun section 40 is substantially identical to second perforating gun section 36 and has a lower cylindrical portion 38 which fits over firing head 20 of second perforating gun section 36. It will be seen that virtually any number of perforating gun sections may be thus positioned above lower perforating gun section 16 and held in place by gun hanger 24. The exact number of additional perforating gun modules or sections will vary depending upon the size of formation 15 and the well conditions. The invention is not intended to be limited to any particular number of gun sections above lower perforating gun section 16.

Also shown in FIG. 3 is a retrievable firing head 42 which is operably connected to the uppermost perforating gun section 40. Firing head 42 is of a kind known in the art and may be positioned on the modular perforating gun system 10 by any means known in the art. In the illustrated embodiment of FIG. 3, firing head 42 is a retrievable firing head which is conveyed on coiled tubing. However, the invention is not intended to be limited to this particular firing head configuration.

In operation, first embodiment modular perforating gun system 10 is fired by actuating firing head 42. This in turn causes sequential firing of each of firing heads 20 on the various perforating gun sections, such as 16, 36 and 40.

Preferably, gun hanger 24 is of the type which includes an automatic gun release so that gun hanger 24 is released from engagement with casing 12 upon firing of the perforating gun sections. Thus, the entire string of perforating gun sections will fall to the bottom of the well or "rathole." If there is sufficient rathole to receive the entire system 10, then no further steps are generally necessary. However, if the rathole is not sufficiently deep, and one or more of the perforating gun sections is still adjacent to perforated formation 15, the gun sections may interfere with production from the well formation. In this case, a known retrieving tool may then be lowered into the wellbore and connected to the uppermost perforating gun section so that this perforating gun section may be raised out of the wellbore. As necessary, additional perforating gun sections may be removed in the same manner. Thus, it is not necessarily a requirement that the entire system 10 be removed, but only that portion of which may cause interference with flow from the perforated formation.

These steps may be taken without killing the well after it has been perforated and is producing. Each of the perforating gun modules or sections is designed to be short enough to be lubricated out at the surface on coiled tubing, wireline or rigid workstring or pipe string without killing the well.

Also, frequently after a well has been producing for some time, the flow weakens to the point that additional perforating may be needed without killing the well. With the modular perforating gun system of the present invention, the gun modules or sections may be lubricated in the well under pressure so that after the modules are in place, the entire perforating gun system may be fired at once to create new perforations to revive the well.

Another advantage of the present invention is apparent in the event that there is a failure in the system and one or more of the gun sections does not fire. Should this occur, the fired gun sections may be retrieved along with the failed section or sections. Any failed section may then be replaced with a new module and the tool rerun into the wellbore so that the replaced failed sections or modules may be fired.

SECOND EMBODIMENT

Figure 4:
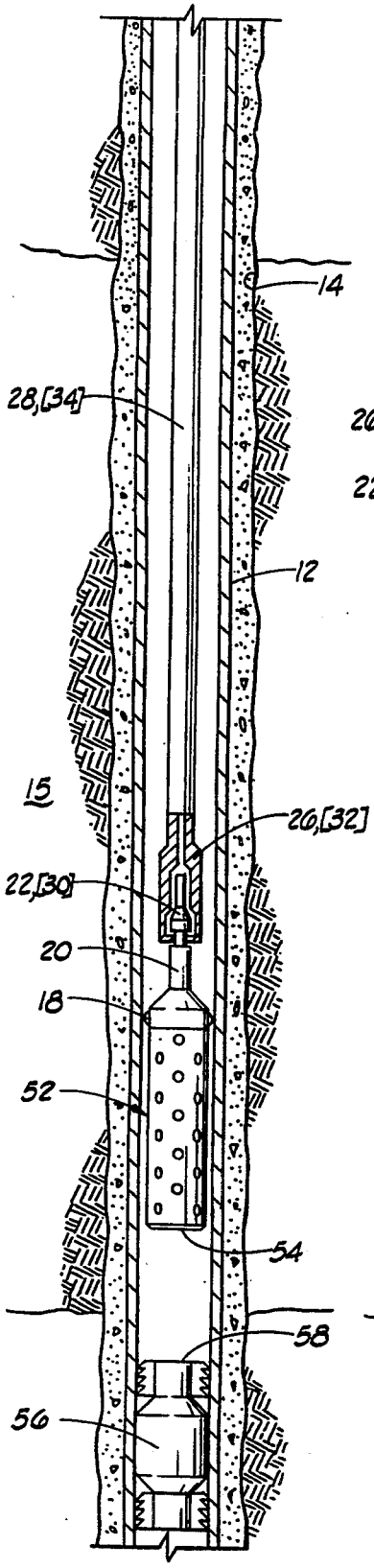
FIG. 4 is a schematic sectioned view of a well in which a first perforating gun section of a second embodiment of the modular gun system of the present invention is shown positioned in a well casing.
Figure 5:
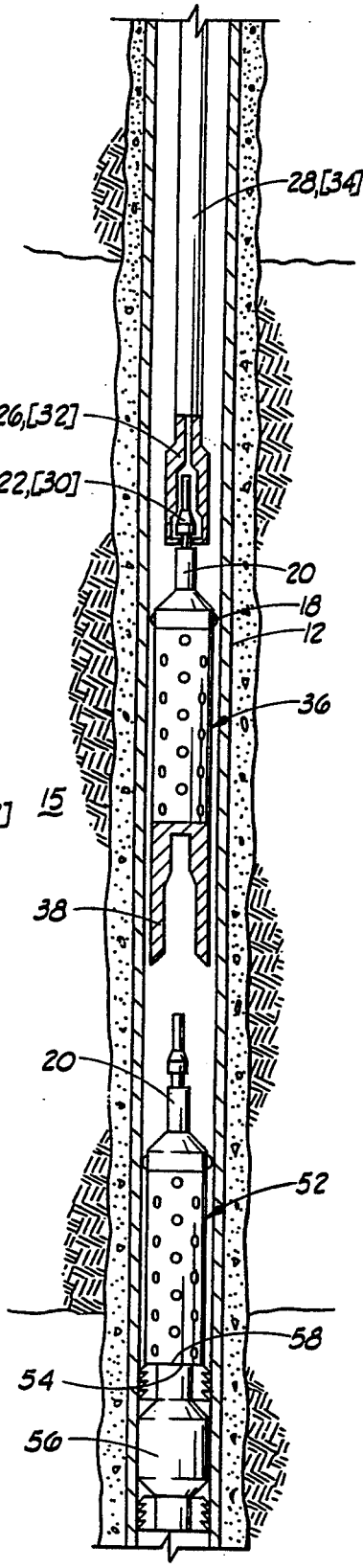
FIG. 5 shows the second embodiment with a second perforating gun section being lowered over the first perforating gun section.
Figure 6:
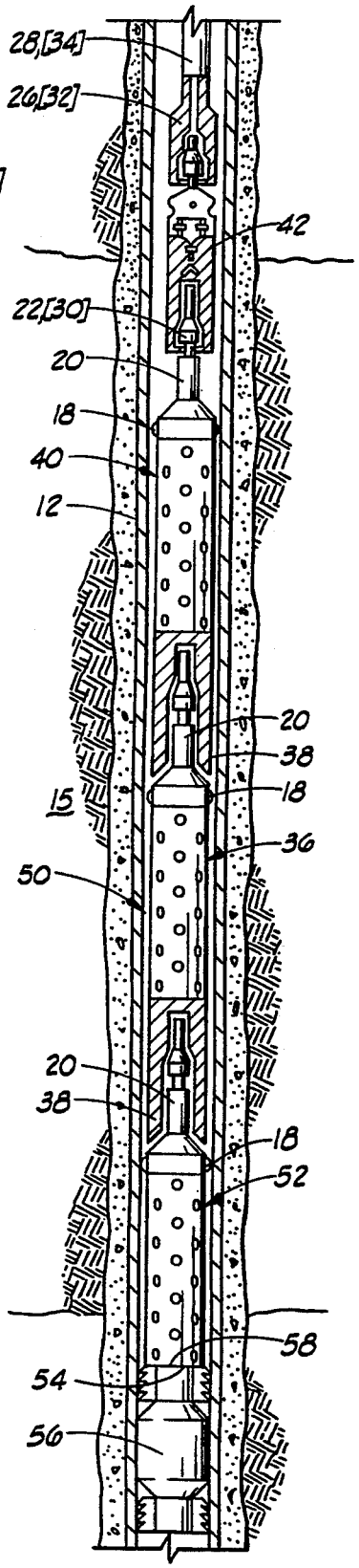
FIG. 6 shows the second embodiment modular gun system with a firing head positioned thereon.

Referring now to FIGS. 4–6, a second embodiment of the perforating gun assembly of the present invention is shown and generally designated by the numeral 50. Second embodiment 50 is similar to first embodiment 10 except that second embodiment 50 includes a lower perforating gun section 52 with a blank lower end 54, rather than including a gun hanger. Lower perforating gun section 52 is otherwise substantially identical to lower perforating gun section 16 previously described, and lower perforating gun section 52 is positioned in casing 12 in the same manner as in the first embodiment.

In second embodiment 50, prior to running lower perforating gun section 52 into casing 12, a bridge plug 56 or other wellbore blocking device of a kind known in the art, is run into casing 12 and placed in locking, sealing engagement therewith at a location generally below formation 15 to be perforated. Lower perforating gun section 52 is lowered into casing 12 until it rests against upper end 58 of bridge plug 56, as best seen in FIG. 5.

Additional perforating gun sections, such as second perforating gun section 36 and third perforating gun section 40 may be stacked on top of lower perforating gun section 52 in a manner substantially identical to that described previously for first embodiment 10.

In operation, the stacking and firing of the perforating gun sections in second embodiment 50 is substantially identical to first embodiment 10. However, upon firing of the perforating guns, bridge plug 56 remains in place, so each of the perforating gun sections is preferably removed from casing 12, including lower perforating gun section 52. The retrieval and/or replacement of perforating gun sections in second embodiment perforating gun system 20 is substantially identical to that previously described for first embodiment 10.

THIRD EMBODIMENT

Figure 7:
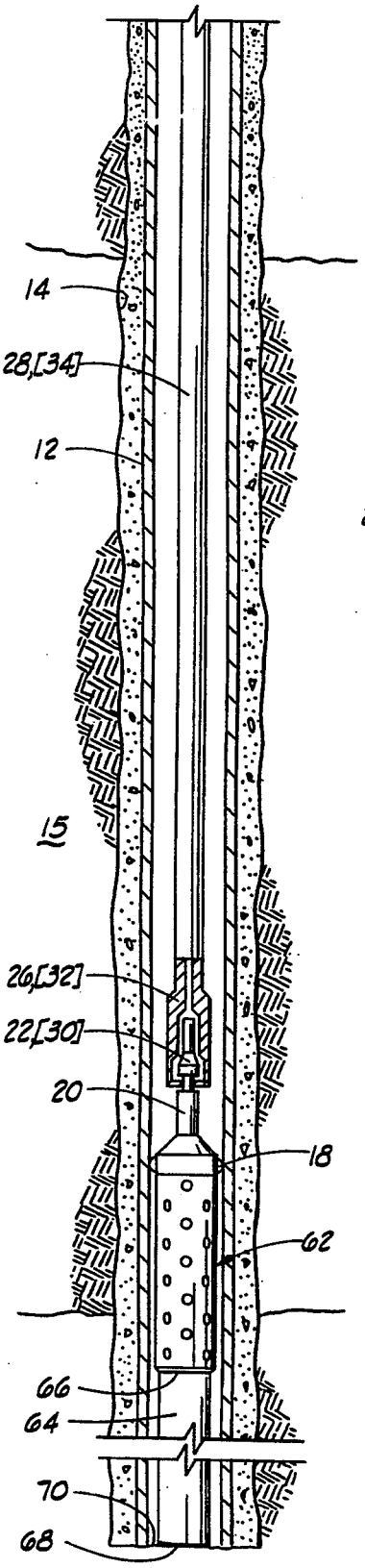
FIG. 7 is a schematic sectioned view of a well in which a first perforating gun section of a third embodiment of the modular gun system of the present invention is shown positioned in a well casing.
Figure 8:
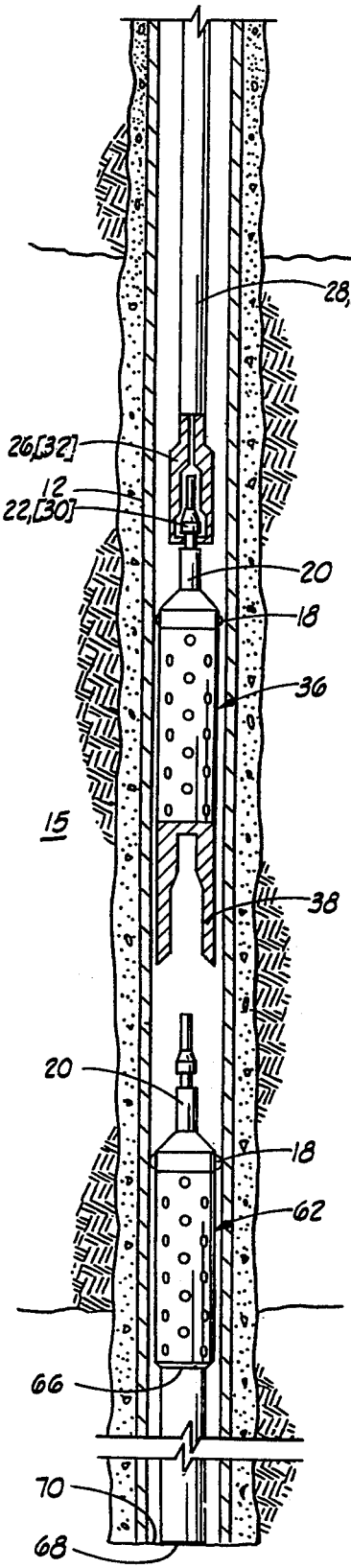
FIG. 8 shows the third embodiment with a second perforating gun section being lowered over the first perforating gun section.
Figure 9:
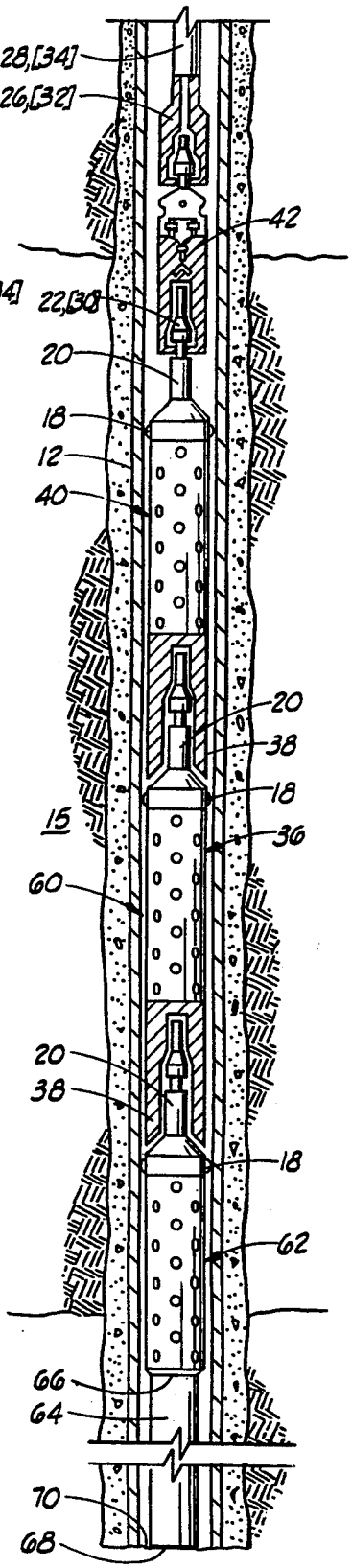
FIG. 9 shows the third embodiment modular gun system with a firing head positioned thereon.

Referring now to FIGS. 7–9, a third embodiment of the modular perforating gun system of the present invention is shown and generally designated by the numeral 60. Third embodiment 60 includes a lower perforating gun section 62 having a length of pipe 64 attached to its lower end 66. Pipe 64 is sized such that lower end 68 thereof rests against bottom 70 of the rathole and positions lower perforating gun section 62 at the desired location with respect to formation 15 to be perforated.

Lower perforating gun section 62 with pipe 64 attached thereto is lowered into casing 12 in a manner substantially identical to the previously described embodiments.

Referring to FIGS. 8 and 9, additional perforating gun sections, such as second perforating gun section 36 and third perforating gun section 40, may be stacked on lower perforating gun section 62 with the entire perforating gun system 60 being supported on pipe 64.

In operation, firing of the perforating gun sections in perforating gun system 60 is substantially identical to that previously described. As with second embodiment 50, after perforation, each of the perforating gun sections, including lower perforating gun section 62, is preferably removed from casing 12. The firing and/or replacement of the perforating gun modules or sections is carried out as previously described.

It will be seen, therefore, that the modular perforating gun system of the present invention is well adapted to carry out the ends and advantages mentioned, as well as those inherent therein. While presently preferred embodiments of the apparatus have been shown for the purposes of this disclosure, numerous other changes in the arrangement and construction of parts may be made by those skilled in the art. All such changes are encompassed within the scope and spirit of the appended claims.

What is claimed is:

1. A method of perforating a casing of a well, said method comprising the steps of:

lowering a first perforating gun section into the casing;

supporting said first perforating gun section in said casing adjacent to a first portion of a subsurface formation to be perforated;

lowering an additional perforating gun section into said casing;

supporting said additional perforating gun section on said first perforating gun section adjacent to another portion of said subsurface formation; and firing said perforating gun sections and perforating said casing.

2. The method of claim 1 wherein said step of supporting said first perforating gun section comprises:

providing a gun hanger on said first perforating gun section; and setting said gun hanger into engagement with said casing.

3. The method of claim 2 further comprising releasing said gun hanger from engagement with said casing after firing said perforating gun sections.

4. The method of claim 1 wherein said step of supporting said first perforating gun section comprises:

providing a length of pipe connected to a lower end of said first perforating gun section; and engaging said pipe with a lower surface in the wellbore.

5. The method of claim 1 wherein said step of supporting said first perforating gun section comprises:

prior to lowering said first perforating gun section, setting a support member into engagement with said casing at a predetermined location; and engaging said first perforating gun section with said support member after lowering said first perforating gun section into said casing.

6. The method of claim 5 wherein said support member is a bridge plug.

7. The method of claim 1 further comprising the step of retrieving at least one of said perforating gun sections from said casing.

8. The method of claim 1 wherein said additional perforating gun section is one of a plurality of additional perforating gun sections, each of said additional perforating gun sections being supported on an adjacent perforating gun section.

9. The method of claim 1 further comprising repeating said step of lowering an additional perforating gun section into said casing as many times as desired.

10. A well perforating apparatus comprising:

a support means engagable with a portion of a wellbore for providing a gun support within said wellbore; and a plurality of perforating gun modules, one of said gun modules being supported by said support means, and the remainder of said gun modules being supported by an adjacent gun module.

11. The apparatus of claim 10 wherein said one gun module is a lowermost gun module.

12. The apparatus of claim 11 wherein said remainder of said gun modules are stacked on said lowermost gun module.

13. The apparatus of claim 10 wherein said support means is characterized by a gun hanger.

14. The apparatus of claim 13 wherein said gun hanger is a portion of said one gun module.

15. The apparatus of claim 14 wherein said gun hanger is an automatically releasing gun hanger.

16. The apparatus of claim 10 wherein said support means is characterized by a plug positionable in said wellbore.

17. The apparatus of claim 16 wherein said plug is a retrievable bridge plug.

18. The apparatus of claim 10 wherein said support means is characterized by a length of pipe attached to said one gun module and adapted for engaging a lower end of said wellbore.

* * * * *